US005111932A

United States Patent [19]

Campbell

[11] Patent Number: 5,111,932

[45] Date of Patent: May 12, 1992

[54] SPREADABLE MATERIAL PACKAGE WITH SPREADER

[75] Inventor: Rolf W. J. Campbell, Minneapolis, Minn.

[73] Assignee: Land O'Lakes, Inc., Arden Hills, Minn.

[21] Appl. No.: 630,993

[22] Filed: Dec. 20, 1990

Related U.S. Application Data

[63] Continuation of Ser. No. 389,063, Aug. 3, 1989.

[51] Int. Cl.[5] ..... B65D 85/74

[52] U.S. Cl. ..... 206/216; 206/469; 206/229

[58] Field of Search ..... 206/216, 219, 461, 469, 206/471, 631, 632, 633, 634, 601, 229

[56] References Cited

U.S. PATENT DOCUMENTS

| | | | |
|---|---|---|---|
| 1,438,487 | 12/1922 | Greene . | |
| 2,248,266 | 7/1941 | Abrams | 206/601 X |
| 2,705,579 | 4/1955 | Mason | 222/129 |
| 2,864,108 | 12/1958 | Johnson | 15/135 |
| 2,938,267 | 5/1960 | Tupper | 30/142 |
| 3,053,385 | 9/1962 | Spees | 206/63.2 |
| 3,069,273 | 12/1962 | Wayne | 99/171 |
| 3,082,468 | 3/1963 | Wattles | 15/506 |
| 3,101,870 | 8/1963 | Betner | 222/107 |
| 3,184,895 | 5/1965 | O'Connor | 53/412 |
| 3,315,801 | 4/1967 | Lowry | 206/56 |
| 3,418,059 | 12/1968 | Robe | 401/266 |
| 3,453,661 | 7/1969 | Repko | 206/484 X |
| 3,635,376 | 1/1972 | Hellstrom | 222/107 |
| 3,660,960 | 5/1972 | Inman | 53/14 |
| 3,917,116 | 11/1975 | Mason | 206/631 X |
| 4,196,030 | 4/1980 | Ausnit | 156/91 |
| 4,369,885 | 1/1983 | Redmond | 206/484 |
| 4,384,649 | 5/1983 | Brodsky | 206/538 |
| 4,391,368 | 7/1983 | Washington, Jr. | 206/484 |
| 4,493,574 | 1/1985 | Redmond et al. | 401/132 |
| 4,648,506 | 3/1987 | Campbell | 206/216 |
| 4,673,085 | 6/1987 | Badouard et al. | 206/631 X |
| 4,797,309 | 1/1989 | Kammerer et al. | 428/35.3 |

FOREIGN PATENT DOCUMENTS

| | | |
|---|---|---|
| 2155069 | 11/1971 | Fed. Rep. of Germany . |
| 0209739 | 6/1986 | Fed. Rep. of Germany . |
| 1278643 | 11/1961 | France . |
| 1398922 | 4/1965 | France . |
| 1488333 | 6/1967 | France . |

*Primary Examiner*—Paul T. Sewell
*Assistant Examiner*—Jacob K. Ackun, Jr.
*Attorney, Agent, or Firm*—Kinney & Lange

[57] ABSTRACT

A spreadable material package includes a first and a second sheet joined together to form a chamber for holding the spreadable material. The package includes a spreader portion at one end that is in flow communication with the chamber so that spreadable material can flow from the chamber to the spreader portion. The package includes a stiffening portion having spaced apart indentations for providing a stiffening effect to the spreader portion.

18 Claims, 3 Drawing Sheets

SPREADABLE MATERIAL PACKAGE WITH SPREADER

This is a continuation of application Ser. No. 07/389,063, filed Aug. 3, 1989.

BACKGROUND OF THE INVENTION

1. Field of the Invention

The present invention relates to packages that hold individual servings of spreadable material such as butter or margarine and that serve as a spreader for such material.

2. Description of the Prior Art

Individual containers are used in restaurants for dispensing individual portions of liquid coffee whitener, and spreadable materials such as butter and ketchup. Many of these containers are cup-shaped and utilize peelable membranes to hermetically seal their contents until the contents are to be used. Examples of such containers are included in the following U.S. patents:

| Inventor | U.S. Pat. No. |
|---|---|
| French Pat. | 1,488,333 |
| Mason | 2,705,579 |
| Wayne | 3,069,273 |
| Inman | 3,660,960 |
| Redmond | 4,369,885 |
| Brodsky | 4,384,649 |

Individual dispenser packages made of heat sealable sheets for holding ketchup or the like, and which must be cut or torn to release the contents are described in the Lowry U.S. Pat. No. 3,315,805.

Applicators are described in the following U.S. patents:

| Inventor | U.S. Pat. No. |
|---|---|
| Wattle | 3,082,468 |
| Repko | 3,453,661 |
| Hellstrom | 3,635,376 |
| Redmond et al | 4,493,574 |

Other types of flexible packaging for packaging various types of powders and flowable materials are described in the following U.S. patents:

| Inventor | U.S. Pat. No. |
|---|---|
| Greene | 1,438,487 |
| Johnson | 2,864,108 |
| Spees | 3,053,385 |
| Betner | 3,101,870 |
| O'Connor | 3,184,895 |
| Robe | 3,418,059 |
| Ausnit | 4,196,030 |
| Washington | 4,391,368 |
| French Pat. | 1,398,922 |
| French Pat. | 1,278,643 |

The Campbell U.S. Pat No. 4,648,506 describes a package with spreader that is hermetically sealed for storing relatively stiff spreadable material such as butter. The package includes a base with a peelable membrane. A portion of the base from which the membrane is peeled is used as a spreader portion for spreading the material within the package. The spreader portion is flat and needs to be relatively thick so that it is stiff enough to provide the support needed to spread relatively stiff margarine or butter.

SUMMARY OF THE INVENTION

The present invention includes a spreadable material package having a first and a second sheet joined together to form a chamber for holding the spreadable material. The package includes a spreader portion at one end that is in flow communication with the chamber such that spreadable material flows from the chamber to the spreader portion. The package further includes a stiffening section having spaced apart indentations for providing a stiffening effect to the spreader portion.

DETAILED DESCRIPTION OF THE PREFERRED EMBODIMENTS

Figure 1:
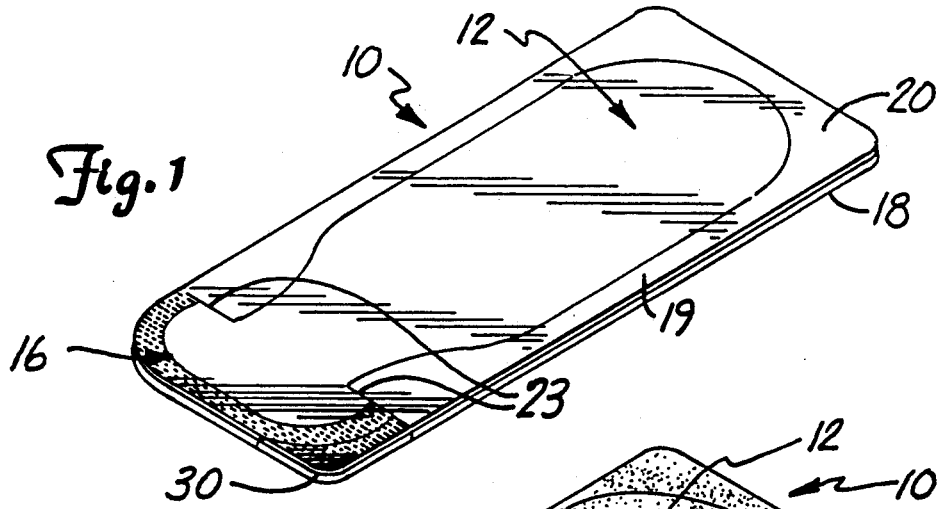
FIG. 1 is a perspective view of the present invention.

A package of the present invention is generally indicated at 10 in FIG. 1. The package 10 includes a supply reservoir portion 12 for holding a spreadable material, a stiffening portion 21, a spreader portion 14, and a sealing section 16 for sealing the contents of the package 10 until needed.

Figure 3:
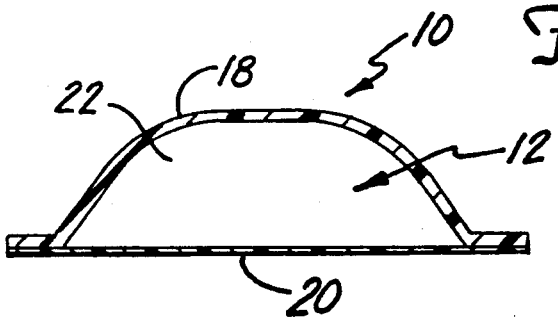
FIG. 3 is a cross-sectional view taken along the line 3—3 in FIG. 2.

The package 10 is formed preferably of two layers of polymeric material. The first layer is a relatively thick vacuum-formed sheet 18 joined at its periphery to a relatively thin film 20, as illustrated in FIG. 3. For ease of understanding and illustration, the "thickness dimension" of the materials has been somewhat exaggerated in the drawings.

It will be understood, that the relative thickness of the sheets 18 and 20 may be interchanged. For example, the sheet 20 may be relatively thick and stiff while the sheet 18 may be thin and flexible and include a reservoir portion 12. The thicker sheet 20 will then provide the stiff backing for the spreader portion 14.

The sheet 18 can be made from any one or more of a number of different suitable materials. Polystyrene has been found to be one suitable material that can be vacuum-formed to the shape of the present invention.

The film 20 can be made from any one of a large number of suitable materials. A frangible or easily rupturable aluminum foil laminate covered on one surface with a poly based, peelable, thermoplastic adhesive has been found satisfactory for purposes of the present invention. The film 20 is joined to the sheet 18 along respective peripheral edge portions to enclose a pouch 22 as best illustrated in FIG. 3. Preferably, the pouch 22 is vacuum-formed in the sheet 18 with the film 20 overlaying the vacuum-formed portion.

The film 20 is joined to the sheet 18 in a fusion-type bond along most of a peripheral edge portion 19. The joining of the sheet 18 with the film 20 defines a pouch 22 for holding of spreadable material. The sealing section 16 includes a thermal bond or seal between the sheet 18 and a portion 28 of the film 20 along a narrow band area 31. The area 31 is adjacent the periphery of the spreader portion 16.

The thermal seal between the sheet 18 and the film 20 provides a mechanism in which the package 10 is opened to reveal the contents of the pouch 22. The film 20 is easily separable from the sheet 18 along the thermal seal. It will be appreciated that the film 20 is torn at a border 23 defined at the juncture of the thermal seal and the fusion bond. Since the sheet 18 and the film 20 are not separable at the fusion bond, the film 20 will tear at the border 23.

The narrow band area 31 serves to spread the spreadable material as is discussed subsequently. It will be appreciated, that since the narrow band area is covered by the portion 28 of the film 20, the narrow band area is kept clean and sterile for use as a blade as is discussed subsequently.

Before the film 20 is joined to the sheet 18, and after the pouch 22 is formed, a spreadable material such as butter, margarine, jelly, or ketchup is introduced into the pouch 22. Although specific food items are mentioned above, the package of the present invention is also usable for other spreadable materials such as paint, putty, caulking, or topical medicinal ointments.

Discrete units of the present invention can be filled individually, or a large sheet containing a number of vacuum-formed pouches, that subsequently will be used to make a number of individual units, can be filled in one step. As can be appreciated, the pouch must face upwardly with its open (concave) side so that the spreadable material can be placed easily therein. After the spreadable material is placed within the pouch, the film 20 is sealed to the sheet 18 along the peripheral edge portion 19 by heat sealing or any other suitable method of joining the film 20 to the sheet 18. The portion 28 of the film 20 overlaying the sealing section 16 includes a coating or thin film that is heat sealable with the sheet 18. The portion 28 peels easily from the sheet 18 due to the thermal seal and due to the narrow band area 31 that is thermally sealed.

Figure 4:
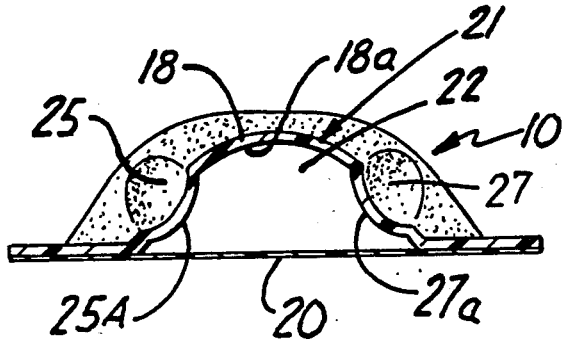
FIG. 4 is a cross-sectional view taken along the line 4—4 in FIG. 2.

To add stiffness to the package 10 of the present invention when used as a spreader, the package 10 includes left and right indentations 25 and 27 formed within the sheet 18 at a forward section of the pouch. Preferably, the pouch 22 includes a necked-down section 21 that extends up to the sealing section 16. The indentations 25 and 27 are disposed on left and right sides of the necked-down section 21, as best illustrated in FIG. 4. The indentations 25 and 27 are convex in cross section, that is, the indentations 25 and 27 have convex inwardly facing surfaces 25A and 27A. The sheet 18 includes an inwardly facing concave surface 18A that spaces the indentations from each other. The indentations 25 and 27 are generally oval when viewed from above, as illustrated in FIG. 6 and are longitudinally oriented with respect to the necked-down section 21.

To open the package and permit the material to be spread, the sealing portion 28 is torn and removed from adjoining contact with the spreader portion of the sheet 18. After removal of the portion 28, the spreadable material is in flow communication with the outside of the package 10.

Figure 2:
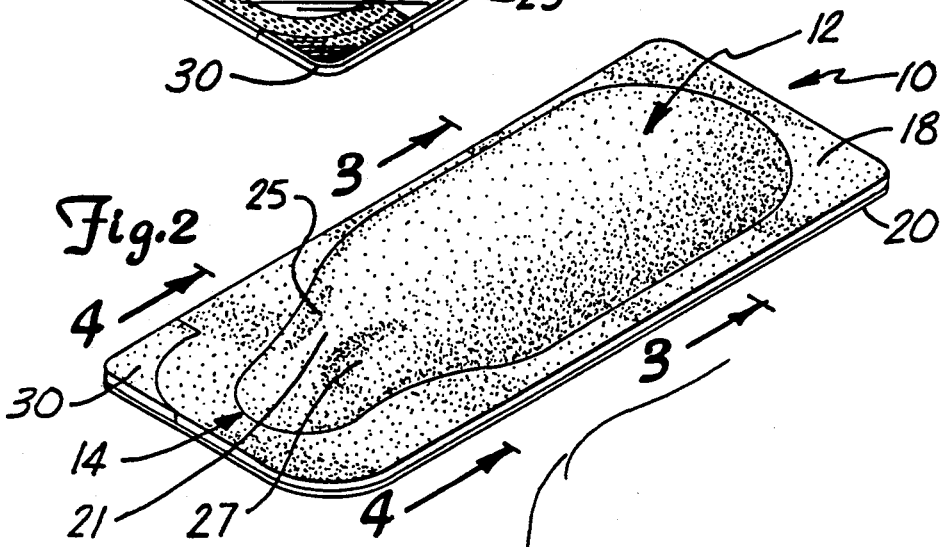
FIG. 2 is a perspective view of the present invention.
Figure 5:
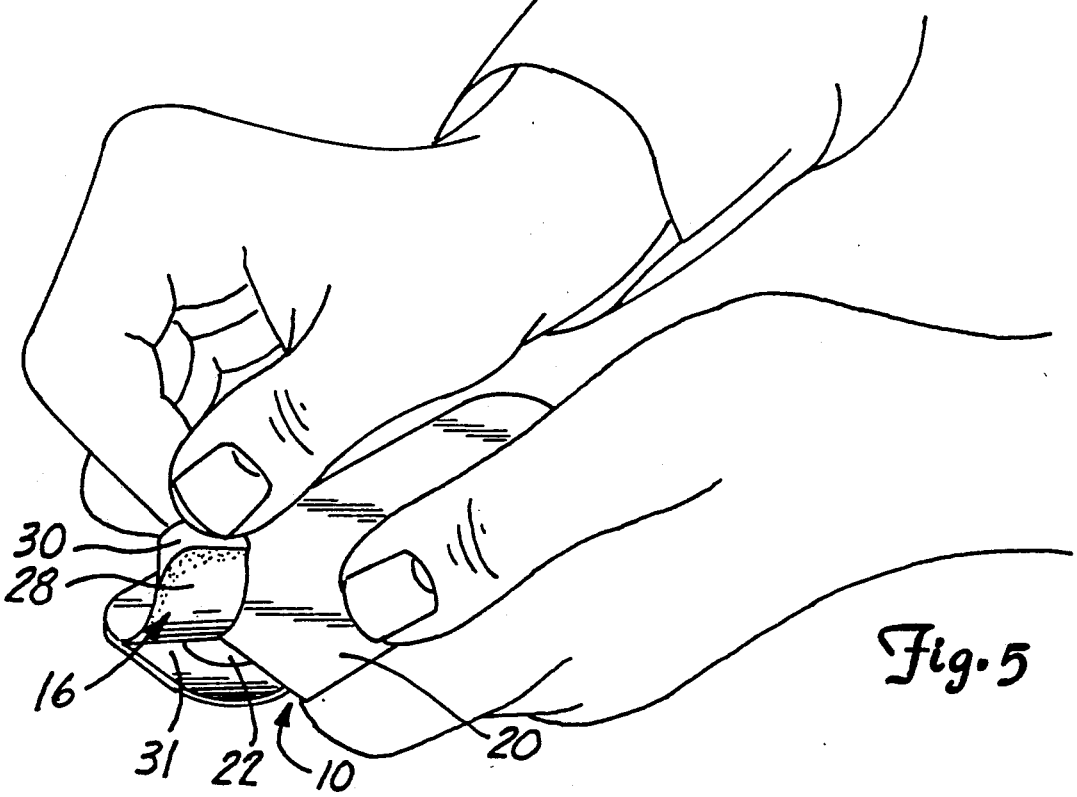
FIG. 5 is a perspective view illustrating the manner of opening the package of the present invention.

In a preferred form, a detachable tab 30 that is detachable from the sheet 18 is provided proximate the spreader portion 16. The sealing portion 28 of the film 20 is secured to the tab 30. As illustrated in FIGS. 1, 2, and 4, the tab 30 is located adjacent the periphery of the spreader portion 16. To open the package 10, the tab 30 is grasped, pulled up and across to remove the film portion 28 and expose the spreadable material to the outside of the package, as indicated in FIG. 4. The tab 30 is preferably die cut from the original sheet material that is used to form the sheet 18. As illustrated, the tab 30 is completely detachable from the spreader portion. If polystyrene is used as the sheet material, a cut of 70 percent through the polystyrene sheet will break off as soon as the tab is bent down with respect to the spreader portion.

Figure 6:
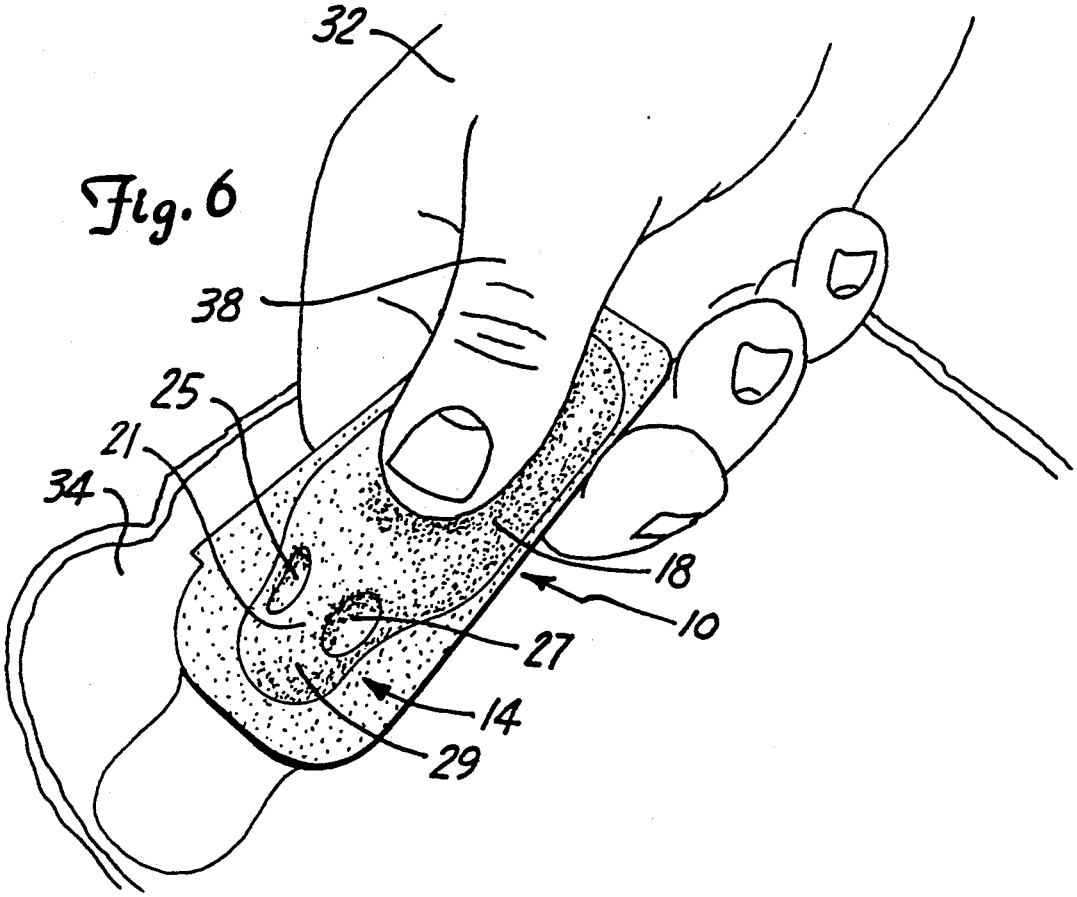
FIG. 6 is a perspective view illustrating the manner of using the package of the present invention in applying the spreadable material.

After the sealing portion 28 is removed from the package the package is grasped as illustrated in FIG. 6. The package 10 can be grasped with one hand 32 with the side having the film 20 facing the spreadable item 34. The package is grasped with a thumb 38 being positioned on the package in position to press against the pouch 22 just rearwardly of the necked-down portion 21. The spreadable material within the pouch is squeezed out by deforming the pouch 22 with the thumb 38. The spreadable material exits the package beneath the spreader portion 14 on to the bread 34.

The indentations 25 and 27 through the necked-down portion provide a stiffening feature to the spreader portion 14 for spreading the spreadable material. Due to the stiffening characteristics, a thinner sheet 18 is used resulting in less material costs. The sheet 18 is also relatively uniform in thickness. For example, sheet material made from polystyrene, high density polyethylene or co-extruded 80 percent polystyrene/20percent high density polyethylene sheet material having a thickness of approximately 0.010 inches (0.0254 centimeters) has been found to provide suitable stiffness for use in the present invention.

The spreader portion spreads a ribbon of butter exactly where the butter is wanted on the bread. The indentations 25 and 27 permit the sheet 18 to be made of a uniformly thick material that permits easy deformation of the pouch 22 by the thumb 38 while providing sufficient stiffness to the spreader portion.

Figure 7:
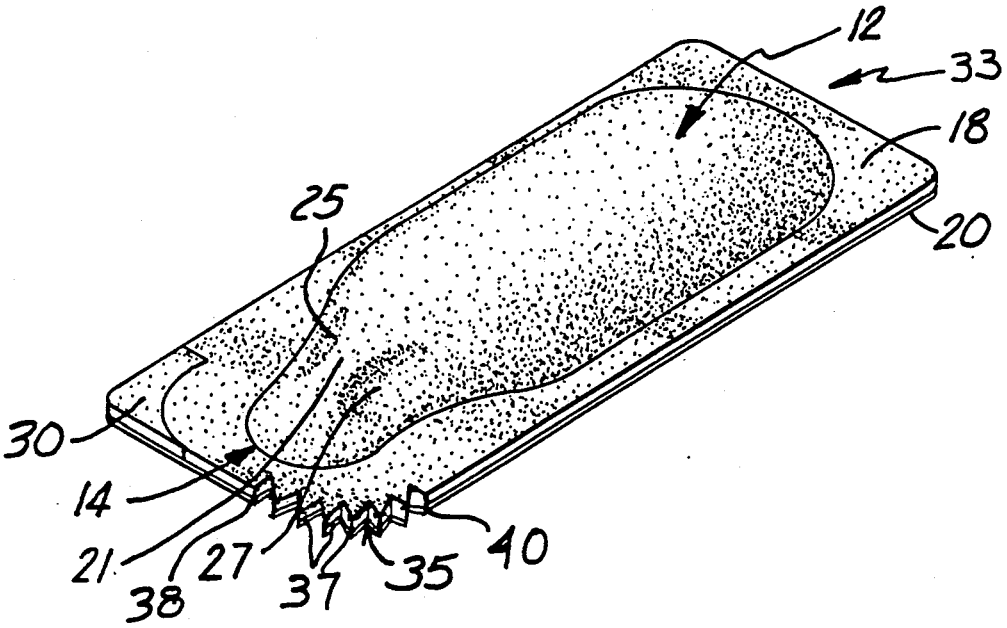
FIG. 7 is a perspective view of an alternative embodiment of the device of the present invention including a serrated blade.

In an alternative embodiment 33 as illustrated in FIG. 7, with like reference characters being used to indicate like elements, the device of the present invention includes a cutting edge 35. The cutting edge 35 is disposed on a corner opposite from the tab 30. The cutting edge 35 includes a plurality of serrations 37 that start from a mid-point 38 of a forward section of the device 10 to a position 40 along a side of the device opposite from the tab portion 30. The serrations 35 may extend as far along the side 40 as desired, but preferably, they need only extend approximately ½ inch or less.

It will be appreciated that the device 33 can be used as a cutting tool for bakery goods (not shown), such as a bun. Prior to pulling off the tab 30 and spreading the contents, the blade 35 may be used to cut open the bakery good (not shown) in a similar manner as a conventional knife.

Although the present invention has been described with reference to preferred embodiments, workers skilled in the art will recognize that changes may be made in form and detail without departing from the spirit and scope of the invention.

What is claimed is:

1. A package having a spreader portion for spreadable material comprising:

a first sheet;

a second sheet joined to the first sheet to form a chamber for holding the spreadable material;

a spreader portion disposed at one end portion joined first and second sheets in flow communication with the chamber; and first and second indentations disposed on the first sheet at a position overlying the chamber such that the indentations provide a stiffening effect to the spreader portion.

2. The package of claim 1 wherein the first sheet is thicker than the second sheet.

3. The package of claim 2 wherein the first sheet has a preformed pouch and the second sheet overlies the pouch to form the chamber.

4. The package of claim 1 and further including means for removing a portion of the second sheet overlying the spreader portion such that the spreadable material flows from the chamber to the exterior of the package.

5. The package of claim 4 wherein the chamber is deformable by finger pressure.

6. The package of claim I and further including a cutting blade portion disposed along one side of the spreader portion.

7. The package of claim 6 wherein the cutting blade includes a plurality of serrations.

8. A package for retaining and for spreading a spreadable material comprising:

a first section having a chamber for holding the spreadable material; and a second section having a spreader portion in flow communication with the first section; and a stiffening section disposed between the first and second sections and overlying the chamber for stiffening the spreader portion.

9. The package of claim 8 wherein the stiffening section includes first and second indentations.

10. The package of claim 9 wherein the indentations have convex surfaces facing inwardly towards the chamber and spaced apart by a concave surface of the chamber.

11. The package of claim 8 wherein the second section includes means for providing an exit opening through which the spreadable material flows to the exterior of the package.

12. The package of claim 8 and further including a cutting blade disposed along a side of the spreader portion.

13. The package of claim 12 wherein the cutting blade includes a plurality of serrations.

14. A package for holding and for spreading a spreadable material comprising:

a first sheet having a first section and a second section with the first section having a spreader portion and the spreader portion having an edge portion and a stiffening section with spaced-apart indentations for providing a stiffening effect to the spreader portion; and a second sheet joined to the first sheet to form a chamber for holding the spreadable material in flow communication with the spreader portion such that the indentations overlie the chamber and the spreadable material is flowable from the chamber to the spreader portion.

15. The package of claim 14 wherein the second sheet includes a removable portion overlying the spreader portion.

16. The package of claim 15 and further including means for removing the removable portion.

17. The package of claim 14 and further including a cutting blade along one side of the spreader portion.

18. The package of claim 17 wherein the spreader portion includes a plurality of serrations.

* * * * *